United States Patent [19]

Wilson

[11] 3,973,905

[45] Aug. 10, 1976

[54] FABRIC TREATMENT

[75] Inventor: David Wilson, West Bridgeford, England

[73] Assignee: Clutsom-Penn International Limited, Coalville, England

[22] Filed: July 3, 1974

[21] Appl. No.: 485,538

[30] Foreign Application Priority Data

July 9, 1973 United Kingdom ..... 32511/73

[52] U.S. Cl. ..... 8/130.1; 28/72 FT; 264/342 RE

[51] Int. Cl.[2] ..... D06M 3/28; D06M 13/08

[58] Field of Search ..... 8/130.1, 178 E, 142; 252/171; 264/343, 342 RE; 28/72 FT; 26/1, 69 R; 260/77.5

[56] References Cited

UNITED STATES PATENTS

| | | | |
|---|---|---|---|
| 2,217,113 | 10/1940 | Hardy | 264/168 |
| 3,017,740 | 1/1962 | Humpreys | 264/342 RE |
| 3,227,793 | 1/1960 | Cipriani | 264/210 F |
| 3,284,871 | 11/1966 | Yano et al. | 264/168 |
| 3,728,301 | 4/1973 | Spence | 260/338 UB |

OTHER PUBLICATIONS

Chem Abst 65: 12,338e.

*Primary Examiner*—Theodore Morris
*Attorney, Agent, or Firm*—Davis, Hoxie, Faithfull & Hapgood

[57] ABSTRACT

A process for the relaxation of fabric containing polyurethane yarn includes the steps of forwarding the fabric continuously through a treatment region in which it is subjected to the action of a swelling agent, for example a chlorinated hydrocarbon, which swells the polyurethane yarn, the treatment being such that the modulus of the yarn is reduced by no more than 12.5 percent, and drying the yarn after it has left the treatment region.

11 Claims, No Drawings

FABRIC TREATMENT

This invention relates to the treatment of fabrics containing polyurethane yarn. The term "polyurethane yarn" is used in this specification to mean a yarn composed of manufactured fibres in which the fibre-forming substance is a long chain synthetic polymer comprised of a substantial proportion of a segmented polyurethane.

Solvent treatment of grey textile fabrics is practised today and fabrics containing polyurethane yarn have been treated with organic solvent. It has been the practice to carry out the solvent treatment of such fabrics by batch processing using a tumbling action because it has hitherto been believed that mechanical working of the fabric was essential to an adequate relaxation of the polyurethane yarn incorporated therein. If the fabric is not adequately relaxed prior to dyeing, "movement" can take place in the fabric during dyeing leading to uneven application of dye.

Surprisingly, it has now been found that if fabric, and specifically knitted fabric, containing polyurethane yarn is treated with an agent which swells the polyurethane yarn, adequate relaxation of the fabric can be achieved even when using continuous processing in which the fabric is not subject to the mechanical action it receives during batch processes such as tumbling. Suitable swelling agents may be organic solvents.

Accordingly, the invention consists in a process for the treatment of fabric containing polyurethane yarn which includes the step of forwarding the fabric continuously through a region in which it is subjected to the action of an agent which swells the polyurethane yarn, the treatment being such that the modulus of the yarn (as hereinafter defined) is reduced by no more than 12.5 percent.

The invention has been found useful for fabrics containing polyurethane yarn such as the yarns sold under the designations "Lycra 124" and "Lycra 126" by E. I. Du Pont de Nemours and Company and also for fabrics containing polyurethane yarn such as the yarn sold under the Trade Mark "Spanzelle" by Courtaulds Limited. It is useful for fabrics containing polyurethane yarn having soft segments based on polyether diols or polyester diols.

Preferably, the swelling agent causes the polyurethane yarn to swell to a marked degree. The degree of swelling induced by a particular swelling agent can be determined by suspending a 25cm length of the polyurethane yarn in the swelling agent at room temperature for 10 minutes with a weight of 0.3gm attached to its lower end. In such circumstances, the extension of yarn should preferably be at least 5 percent but not more than 30 percent and better less than 25 percent.

Advantageously, the swelling agent is also a dry cleaning agent and therefore relaxation of the fabric and solvent scouring are combined in one continuous process.

In carrying the process according to the invention into effect, grey (undyed) fabric containing polyurethane yarn is passed continuously through a machine for the continuous treatment of fabric and is subjected to the action of a swelling agent, for example by passage through a bath of the liquid swelling agent or by subjecting it to a spray of the liquid swelling agent or both. The fabric may, in addition, or as an alternative, to treatment with the swelling agent in the liquid phase, be subjected to the action of the swelling agent in the vapour phase in the absense or presence of air.

Treatment in the liquid phase may be carried out by use of a J-box. The machine use for the treatment is preferably a machine in which underfeed of feed-in nip rollers relative to final nip rollers in the treatment stage can be varied to an extent such as to accommodate considerable extension of the fabric during the treatment with the swelling agent, for example an extension of 30 percent.

The fabric is then dried, for example by a current of hot air and may be passed directly to a dyeing machine for dyeing under conditions of continuous processing. (Continuous processing implies processing of very long lengths of fabric, not literally never-ending lengths).

When using liquid perchlorethylene as the swelling agent, the fabric is advantageously maintained in the wet state for 1 to 2 minutes at a temperature in the range 30°C to 50°C, preferably 40°C.

The drying conditions for fabric processed according to the present invention should be such that substantial length shrinkage, for example 30 percent, of the fabric can occur during drying in order to promote length relaxation of the fabric and avoid "length set". Hot air for example, at 100°C may be used to dry the fabric.

When treating fabrics including water shrinkable non-elastic ground yarns, for example polyamide yarns, a small quantity of water, between 0.5 and 1.5 percent on the volume of the swelling agent is advantageously added to the swelling agent to promote shrinkage of the ground yarn.

Table I below, shows the results obtained in relaxing three fabrics by a process in accordance with the invention. Each fabric was treated by immersion for 2 minutes in a J-bath containing perchlorethylene at 40°C. The fabric was dried by hot air immediately after leaving the J-bath, in the same continuous pass through the treatment machine, and left the drying chamber at a speed of 30 meters per minute. The relaxation in width and length directions was determined by measuring the initial dimensions under zero tension direct off the beam on which the fabric was wound up on the knitting machine and the final dimensions under zero tension after drying. Column A shows in each case the relaxation obtained using perchlorethylene alone and Column B shows the relaxation obtained using perchlorethylene with an admixture of 1 percent by volume of water (on the volume of perchlorethylene).

Table 1

| Fabric | Length Relaxation (per cent) A | Length Relaxation (per cent) B | Width Relaxation (per cent) A | Width Relaxation (per cent) B |
|---|---|---|---|---|
| Powernett containing 310 decitex "Lycra 124" | 6 | 6 | 26 | 29 |
| Satin containing 310 decitex "Lycra 124" | 14 | 14 | 38 | 41 |
| Tricot containing 44 decitex "Lycra 126" | — | 18 | — | 54 |

Table II below, shows the effect of a number of organic solvents in swelling polyurethane yarn and the effect on the modulus of the yarn. The term "modulus" is used in this specification in the following sense: yarn is subjected to two cycles of a conventional stress-strain regime on the second extension, the load at 100 percent extension is measured and this is the modulus of the yarn.

Results of experiments on Lycra 124 yarn, Lycra 126 yarn and High Modulus Spanzelle yarn are shown in Table II. The experiments were carried out by suspending a 25cm length of 310 decitex yarn by one end in the swelling agent under test for 10 minutes at room temperature (20°C), a weight of 0.3gm being attached to the lower end of the length of yarn. At the end of the 10 minutes the extension of the yarn was measured. The yarn was then dried by allowing the solvent to evaporate at room temperature and its length when dry (relaxed length) was measured. The yarn was then subjected to two cycles of a stress-strain regime up to 150 percent extension to determine the modulus.

The Table II, Column A gives percentage extension after 10 minutes in swelling agent; Column B gives percentage relaxation (decrease on initial length) of dried yarn; Column C gives modulus (gm); and Column D gives percentage decrease in modulus.

TABLE II

| SOLVENT | YARN:- "LYCRA 124" A | B | C | D | "LYCRA 126" A | B | C | D | High Modulus "SPANZELLE" A | B | C | D |
|---|---|---|---|---|---|---|---|---|---|---|---|---|
| perchorethylene | 22 | 1.3 | 12.0 | 0 | 19 | 1.0 | 10.4 | 0 | 5 | 1.6 | 10.0 | 0 |
| carbon tetrachloride | 28 | 2.4 | 11.9 | 1 | 24 | 2.9 | 10.5 | 0 | 17 | 3.6 | 10.0 | 0 |
| methylene chloride | 35 | 6.2 | 9.5 | 21 | 32 | 7.1 | 8.0 | 24 | 39 | 7.8 | 8.8 | 12 |
| chloroform | 42 | 7.8 | 9.0 | 25 | 46 | 10.7 | 6.5 | 38 | 42 | 9.3 | 8.8 | 12 |
| 1:1:1 trichloroethane | 27 | 2.6 | 11.4 | 5 | 25 | 1.6 | 10.0 | 3 | 19 | 2.9 | 10.0 | 0 |
| 1:1:2:2 tetrachloroethane | 42 | 7.5 | 10.0 | 16.7 | 47 | 8.9 | 6.7 | 36 | 45 | 8.5 | 8.5 | 15 |
| trichlorethylene | 30 | 3.4 | 10.5 | 12.5 | 26 | 3.3 | 9.5 | 9.5 | 19 | 47 | 9.7 | 3 |
| White spirit | 0 | 0 | 12.0 | 0 | 0 | 0 | 10.5 | 0 | 0 | 0 | 10.0 | 0 |
| Petroleum ether (boiling 60°–80°C) | 0 | 0 | 12.0 | 0 | 0 | 0 | 10.5 | 0 | 0 | 0 | 10.0 | 0 |
| Untreated Yarn | — | — | 12.0 | — | — | — | 10.5 | — | — | — | 10.0 | — |

Experiments were also carried out with a mixture of equal parts by volume of chloroform and perchlorethylene and the swelling observed was approximately mid-way between that observed for these solvents separately. It is expected that mixtures of other solvents would behave in the same way. Polyurethane yarns were suspended in air in the saturated vapour of carbon tetrachloride and also of methylene chloride and a swelling effect was observed.

A decrease in the modulus of the polyurethane yarn of greater than 12.5 percent during processing is regarded as unsatisfactory and preferably the modulus should not decrease by more than 5 percent. Decrease in modulus is correlated with increase in length of the yarn when in the solvent. The change in modulus under processing conditions will not necessarily be the same as the change recorded in the experiments reported in Table II but this Table gives results which may be very roughly taken as equivalent to processing in liquid swelling agent for two minutes at 40°C and in any case shows the relative order of merit of the swelling agents tested. Thus a length extension in the swelling agent in Table I (Column A) of more than 30 percent is to be regarded as undesirable but an extension of at least 5 percent is probably necessary to achieve an acceptable degree of relaxation. Preferably the length extension in the swelling agent under the conditions of Table I should not be more than 25 percent.

What is claimed is:

1. A process for the treatment of knitted fabric containing polyurethane yarn, said process comprising the steps of a. forwarding the fabric continuously through a treatment region b. subjecting said fabric in said region to the action of a swelling agent to swell the polyurethane yarn under conditions such as to reduce the modulus of said yarn by not more than 12.5 percent, and c. drying said yarn after it has left said treatment region, thus causing said fabric to undergo relaxation in both length and width.

2. A process as claimed in claim 1 wherein said treatment is such that said modulus of the yarn is reduced by no more than 5 percent.

3. A process as claimed in claim 1 wherein the swelling agent is such that a 25cm length of the polyurethane yarn suspended in the agent at room temperature for 10 minutes with a weight of 0.3gm at its lower end will extend by at least 5 percent but not more than 30 percent.

4. A process as claimed in claim 3 wherein the swelling agent is such that said suspended length of yarn will extend by no more than 25 percent.

5. A process as claimed in claim 1 wherein the swelling agent is selected from the group consisting of chlorinated hydrocarbons and mixtures of chlorinated hydrocarbons and the fabric is subjected to the action of the swelling agent in the liquid phase.

6. A process as claimed in claim 5 wherein the fabric is immersed in a bath of the swelling agent.

7. A process as claimed in claim 5 wherein the swelling agent is perchlorethylene.

8. A process as claimed in claim 1 wherein the fabric includes a water shrinkable non-elastic ground yarn and the fabric is subjected to the action of the swelling agent in the liquid phase in admixture with a small quantity of water.

9. A process as claimed in claim 1 wherein the swelling agent is selected from the group consisting of chlorinated hydrocarbons and mixtures of chlorinated hydrocarbons and the fabric is subjected to the action of the swelling agent in the vapour phase.

10. A process as claimed in claim 9 wherein the quantity of water is from 0.5 to 1.5 percent by volume on the volume of the swelling agent.

11. The process claimed in claim 1 wherein the fabric is relaxed to a greater degree in the width direction than in the length direction.

* * * * *